United States Patent [19]

Achelpohl et al.

[11] 4,162,602

[45] Jul. 31, 1979

[54] METHOD AND APPARATUS FOR FILLING AND CLOSING LARGE SACKS

[75] Inventors: Fritz Achelpohl; Richard Feldkämper; Carl Langemeyer; Konrad Tetenborg; Hartmut Upmeier, all of Lengerich, Fed. Rep. of Germany

[73] Assignee: Windmoller & Holscher, Lengerich, Fed. Rep. of Germany

[21] Appl. No.: 850,200

[22] Filed: Nov. 10, 1977

[30] Foreign Application Priority Data

Nov. 15, 1976 [DE] Fed. Rep. of Germany ..... 2652010

[51] Int. Cl.[2] ..... B65B 1/04; B65B 7/06; B65B 39/08; B65B 43/30

[52] U.S. Cl. ..... 53/415; 53/137; 53/138 A; 53/266 R; 53/417; 53/459; 53/469

[58] Field of Search ..... 53/14, 29, 37, 44, 138 R, 53/138 A, 187, 188, 190, 266, 137, 415, 417, 459, 469, 481, 570, 571, 573

[56] References Cited

U.S. PATENT DOCUMENTS

| | | | |
|---|---|---|---|
| 2,493,063 | 1/1950 | Frank et al. | 53/14 X |
| 2,670,294 | 2/1954 | Frank | 53/14 X |
| 3,488,910 | 1/1970 | Stoger et al. | 53/14 |
| 3,503,179 | 3/1970 | Pierre | 53/188 |
| 3,943,687 | 3/1976 | Cerioni | 53/188 |

*Primary Examiner*—Horace M. Culver
*Attorney, Agent, or Firm*—Fleit & Jacobson

[57] ABSTRACT

Sacks are successively filled and closed in an automatic process by suspending each sack from near the mouth and spreading the side walls apart, filling the sack, allowing it to settle on a support while keeping the side walls taut, bringing the side walls together near the mouth and folding them over onto themselves, welding a closure tape over the folded-over portion and the adjoining unfolded portion of the sack, crimping the unfilled upper part of the sack and gathering it to form a frill, and applying a clamping ring beneath the frill.

6 Claims, 9 Drawing Figures

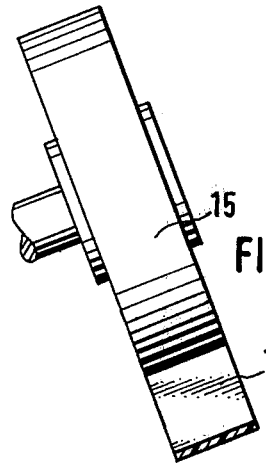
FIG.7
FIG.8
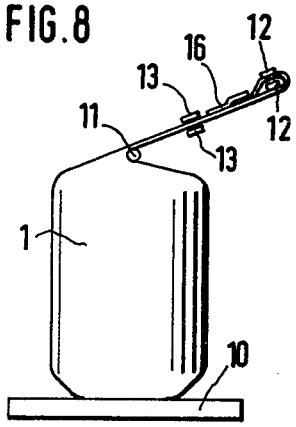
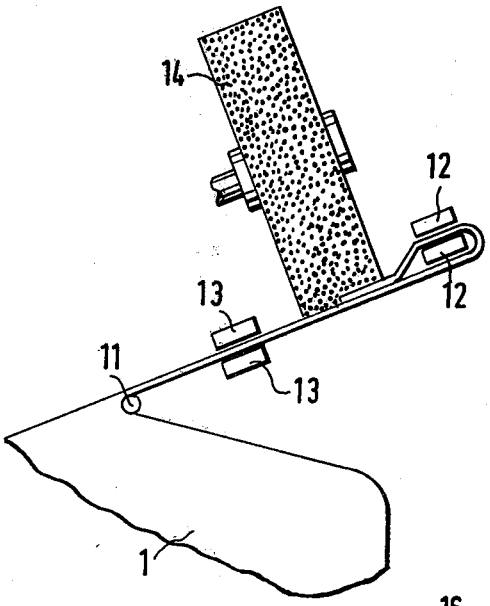
FIG.9
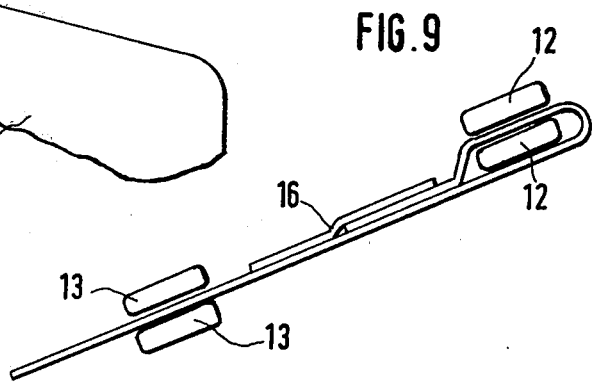

METHOD AND APPARATUS FOR FILLING AND CLOSING LARGE SACKS

The invention relates to a method of fully automatically filling and closing large sacks, wherein tube sections provided with bases and open at the top are filled with pourable material and the open upper margins are pulled together and interconnected, and to an apparatus for performing this method.

In the method for filling and closing sacks as known from DT-OS No. 1 948 227 as well as DT-GS No. 7 432 327, sacks provided with bases are stored in magazines, the sacks are withdrawn therefrom for the purpose of filling them, and the filled sacks are closed by welding the upper margins of the opening. However, by means of such known methods it is possible to fill and close only small sacks which are easily handled and which are usually subsequently stacked on pallets for conveying and storing purposes. However, there is a problem in the filling, closing and transporting of large sacks of which the filled weight is roughly equal to the weight of conventional pallet stacks.

It is therefore the object of the present invention to provide a method for filling and closing large sacks of which the filling aperture is closed after filling to be sealed against sprayed water and is suitable for lifting by means of a lifting apparatus.

This object is solved according to the invention in that a tube section provided with a base is engaged laterally at its upper end, and is opened at the top by pulling the sack walls apart. The pourable material is first fed into the freely suspended sack, the sack is thereby slowly deposited on a support while maintaining tension in the side walls, the upper end of the tube section is closed by stretching the side walls, and the sack walls disposed above the filling material are laid together and turned over sideways through an angle. Then the upper end of the sack walls is folded over onto itself, a closure tape is placed onto the folded-over end and one sack wall and welded to the sack wall and folded-over end by two parallel weld seams. The empty upper end of the sack is then re-erected substantially vertically, folded in zig-zag fashion and pulled together to form a frill, and an annular clip is placed about the pulled-together sack portion beneath the frill. According to the method of the invention, the pourable material is first filled into the freely suspended sack, The sack is thereby stretched over its entire length so that the base can advantageously be filled out evenly by the filling material. After the sack has been partly filled, it is slowly deposited on a support so that the sack can receive the required amount of contents. The filling step is terminated while maintaining the tension in the side walls so that no folds can be formed in the side walls. By stretching the side walls the filling aperture is closed and by placing the sack wall portions located above the filling material against one another the air enclosed in the sack is removed. This portion is turned over laterally so that the upper end of the sack is readily accessible for easy folding over. By folding over the upper sack margin onto itself and by welding the sack wall and the folded-over sack margin to the closure tape one obtains a sack closure that is waterproof against sprayed water. To enable the sack to be welded to a closure tape, it is of a weldable or heat-sealable material.

After erecting the upper empty end of the sack to a substantially vertical position, it is laid into zig-zag folds which are pulled together beneath the regular folds so that a regular 'frill' is formed. At this position an annular clip is placed about the crimped end of the sack.

The regular folded-together and flattened end of the sack can advantageously and simply be slung about the clamping bars of lifting tackle with which the sack can be readily lifted and transported. No special suspension eyelets or lugs that would make the sack more expensive need be provided because the sack can be lifted and transported by applying the lifting means to the crimped upper end of the sack.

If the sack should topple over during transport from its regular vertical position and assume a predominantly horizontal position, the filling material would get into the regular folds of the frill, break them open and fill out large portions of the upper end of the sack. The upper end of the sack can then no longer be slung about the clamping bars of lifting tackle for lifting and transporting purposes and the sack would have to go to waste. The clamping ring therefore has the purpose of preventing the filling material from reaching the upper end of the sack. Since the clamping ring ensures that the crimped upper end of the sack remains even when the sack has toppled over, lifting tackle can also be used to erect toppled-over sacks and transport them.

An apparatus for performing the method of the invention and comprising grippers for engaging the sacks and feeding them, while opened by suckers, to the filling nipple of a funnel, which nipple is provided with clamping jaws, and comprising conveyor means for supporting the filled sack and conveying it to closure means, is characterised according to the invention in that the filling nipple is surrounded by plates which surround the filling nipple telescopically and extend same, are lowerable under the weight of the sack becoming filled and are spreadable against the clamping jaws moving therewith, and that provision is made for grippers for folding back the filling end of the sack onto itself after it has been pulled smooth over a bar, means for welding a closure tape over the sack wall and the filling end, folding plates which interengage like a comb and place the upper margin of the sack in a zig-zag line, push members which are movable towards each other to crimp the pre-folded sack margin, and means for clamping by means of an enveloping band the sack margin which has been crimped to form a frill.

Advantageous embodiments of the invention are described in more detail in the subsidiary claims.

An example of the invention will now be described in more detail with reference to the drawing, in which:

FIG. 7 is an enlarged representation of the closure tape reel and the cleaning brush;

FIG. 8 is a section of the sack on the line VIII—VIII in FIG. 1, and

FIG. 9 is an enlarged representation of the end of the sack welded shut by the closure tape.

Figures 1, 2:
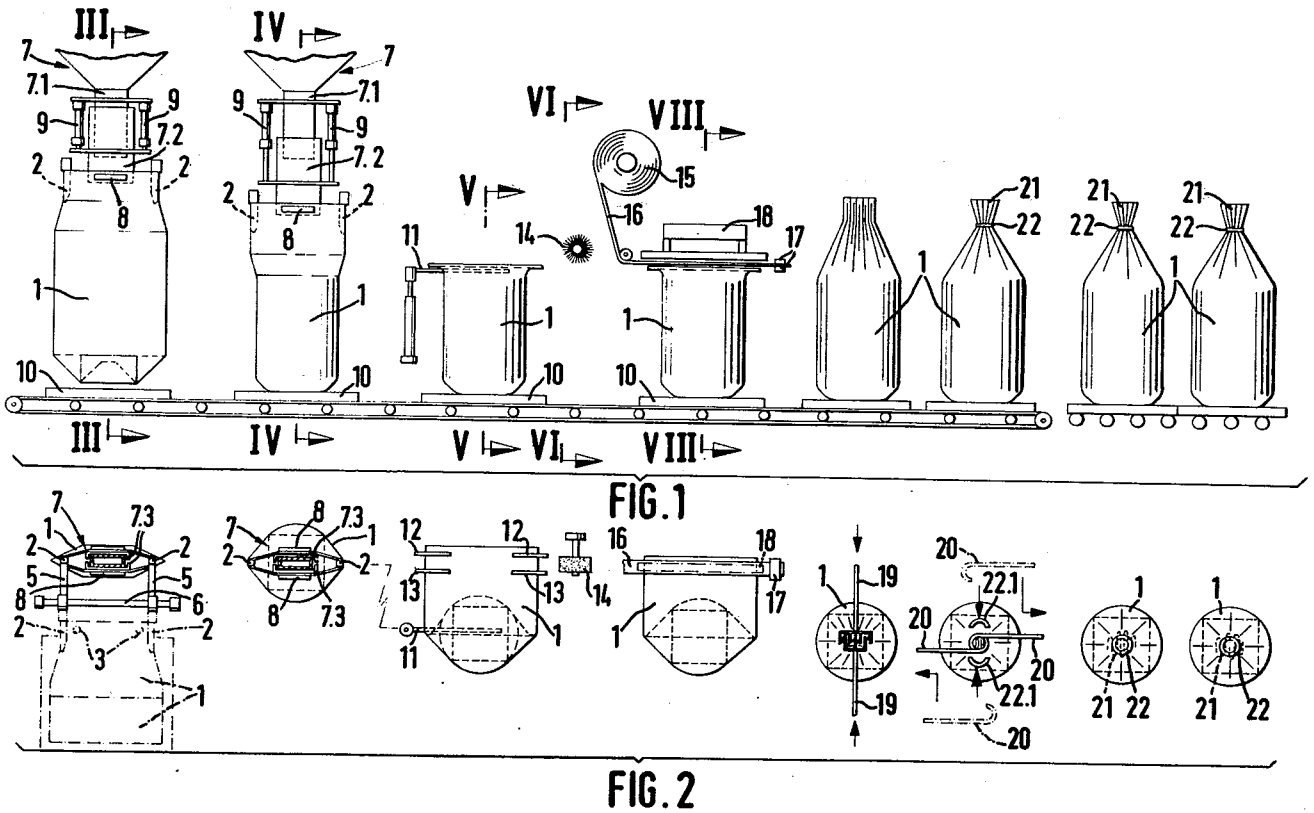
FIG. 1 is a diagrammatic side elevation showing the sack at the individual filling and closing stations.
FIG. 2 is a plan view of the sack at the individual stations of FIG. 1.
Figure 3:
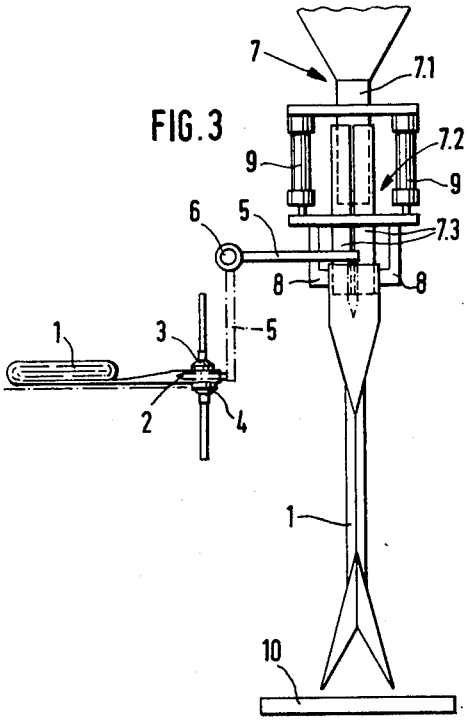
FIG. 3 is a section on the line III—III in FIG. 1 of the sack suspended from the filling funnel.
Figure 4:
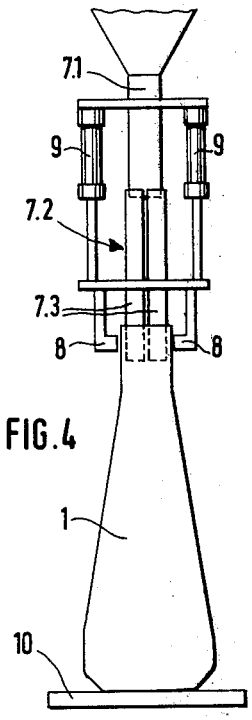
FIG. 4 is a section on the line IV—IV in FIG. 1 of the sack when in its filling position.
Figure 5:
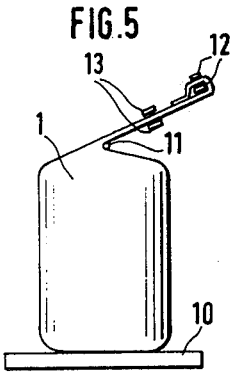
FIG. 5 is a section of the sack on the line V—V in FIG. 1.
Figure 6:
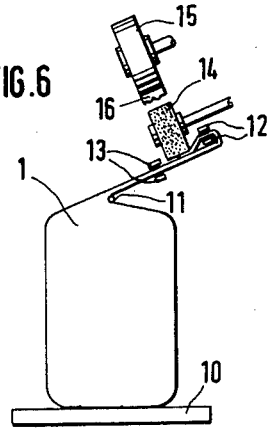
FIG. 6 is a section of the sack on the line VI—VI in FIG. 1.

In a first station comprising the engaging, suspending and filling of the sack as well as turning over of the filling end of the sack, a flattened or folded sack 1 is engaged at both sides at its upper end by grippers 2 as shown in FIG. 3, after its two side walls had been pulled apart by suckers 3, 4, which can also take place after the sack is gripped. The grippers 2 are secured to a swing arm 5 with a rotary shaft 6. The swing arm 5 swings to a substantially horizontal position so that the sack 1 is freely suspended and its filling end engages over the mouth of a filling funnel 7. The funnel 7 is in two parts, the upper part 7.1 projecting into the lower part 7.2 and the lower part 7.2 consisting of two spreadable funnel segments 7.3. Disposed adjacent the filling funnel aperture to the right and left thereof, there are clamping jaws 8 which are secured to the carrier of the spreadable funnel segments 7.3. During opening of the funnel segments 7.3, each of the two walls of the upper end of the sack is clamped and thereby held tight between a respective funnel segment 7.3 and one of the clamping jaws 8. The lower portion 7.2 of the filling funnel 7 is mounted for movement towards the upper portion 7.1 and surrounds the upper portion 7.1. The clamping jaws 8 are securely fixed to the lower portion 7.2. The two portions 7.1 and 7.2 are intercoupled by pressure cylinders 9 to which a particular adjustable force is applied by their pressure medium. The pourable material is first filled in the freely suspended sack, whereby the sack is stretched over its entire length so that the sack can receive the prescribed amount of contents. When the weight that increases during filling exceeds the set force of the pressure cylinder 9, the lower portion 7.2 of the filling funnel 7 descends together with the sack 1 so that the latter rests on a support 10 with its base and the base is uniformly filled out the filling material. By reason of the stress applied by the pressure cylinder 9, the walls of the sack 1 are kept taut so that no folds can be produced in the walls of the sack.

After filling, the grippers 2 are swung back to enable them to engage a new sack 1.

The walls of the filled sack 1 are folded sideways over a bar 11 which is disposed approximately above the filling level of the sack 1 and is swung up to the center of the sack, and are engaged at a spacing from one another by pairs of grippers 12, 13. The pair 12 of grippers folds the end of the sack back onto itself through about 180°. For the purpose of cleaning, a rotating brush 14 is passed over the folded end of the sack and the adjacent portion of the sack wall on which the folded-over portion lies, this taking place whilst the sack 1 is being conveyed to a second station. In the latter, a closure tape 16 is pulled off a supply reel 15 by a gripper 17 which engages the end of the closure tape 16 and is reciprocated in the conveying direction of the sack 1. Desirably, the gripper 17 carries out the pulling-off motion simultaneously with movement of the sack 1 from the first station to the second station while the sack 1 is being brought under the closure tape 16. The closure tape 16 is held by the gripper 17 partly over the sack wall and partly over the folded-over upper end of the sack and is there welded to the sack wall and the folded-over end by means of two weld seams applied by a stationary welding jaw 18.

The empty upper end of the sack 1 is erected vertically by moving the bar 11 upwardly and is laid into zig-zag folds by a folding tool 19 which consists of two parts and is advanced onto the upper end of the sack from both sides in a horizontal direction, the two parts interengaging like a comb. By means of pull rods 20 of which the ends are curved and which are in a mirror-image arrangement to one another, the zig-zag folding is gathered to form a frill 21. For this purpose their curved ends are placed about the folds and moved apart in opposite directions.

After withdrawal of the pull rods 20, a ring clip 22 is applied to the sack 1 at this location between the filled portion of the sack 1 and the frill 21. The clip consists of two segments 22.1 provided with snap closures which, when they are plugged together, hook into one another irreleasably.

We claim:

1. A method of filling and closing large sacks, each large sack having a tube section including side walls, a base, and an open end portion to receive the material to be poured therein, the method comprising the steps of: engaging the open end portion of the sack at opposite sides thereof and opening the side walls of the sack, freely suspending the sack from its open end portion, depositing a pourable material through the open end portion of the freely suspended sack to partially fill the sack, gradually lowering the sack onto a support when a predetermined weight of material is deposited therein while maintaining tension on the side walls of the sack, laying together, stretching and inclining sideways through an angle, the sack walls disposed above the pourable material within the sack, folding the upper end portion of the sack over onto itself, placing closure tape onto the folded-over end portion of the sack and one sack wall and welding the folded-over end portion to the sack wall, moving the inclined side wall portion of the sack, disposed above the poured material, through an angle to a substantially vertical position, folding the empty upper portion of the sack in a zig-zag manner, pulling the zig-zag folded portion together to form a frill, and clipping the sack portion, with an annular clip, beneath the frill.

2. A method according to claim 1, further comprising the step of cleaning the upper end of the sack walls before the closure tape is applied.

3. The method as claimed in claim 1, wherein said engaging and opening steps comprise gripping the opposite sides of the open end portion of the sack by a pair of grippers and opening the sack by suckers; the depositing and lowering steps comprise providing a funnel having a filling nipple, and surrounding telescopic plates, clamping the upper end portion of the sack between the telescopic plates and a pair of clamping jaws, and gradually lowering the telescopic plates and clamping jaws when a predetermined weight of material is deposited from the filling nipple into the sack to lower the sack onto a conveyor for supporting the sack; the laying together, stretching, inclining, and folding steps comprise gripping the upper end portion of the sack and pulling the empty upper portion of the sack over a bar, and then folding the upper end portion of the sack at the gripped portion; the folding step comprises providing a pair of folding plates at opposite sides of the upper portion of the sack, moving the folding plates towards each other to interengage in a comb-line manner to place the upper portion of the sack in a zig-zag line; and the pulling step comprises positioning a pair of curved end members about the upper portion of the sack and pulling the end members apart to crimp the upper end portion of the sack.

4. An apparatus for filling and closing large sacks, each large sack having a tube section including side walls, a base, and an open end portion to receive the material to be poured therein, gripping means for engaging a sack and for feeding the sack to a funnel for depositing material into the sack, said funnel having a filling nipple, wherein the improvement comprises a pair of telescopic plates surrounding the filling nipple of the funnel, clamping means for clamping the sack to the pair of telescopic plates comprising a pair of clamping jaws adjacent the pair of telescopic plates, lowering means for gradually lowering the clamping jaws and a pair of telescopic plates, when the sack is partially filled with a predetermined amount of material, to a conveying means, conveying means for conveying the partially filled sack to a closure means for closing the upper portion of the sack, said closure means comprising second gripping means for gripping the end portions of the sack together, means for stretching the side walls of the sack comprising a bar and means for moving the bar relative to the sack, folding means for folding over the end portion of the sack, means for welding a closure tape over the folded-over end portion of the sack to the sack wall, a pair of folding plates having interengagable comb-like projections, means for compressing the end portion of the sack between the folding plates to form a zig-zag fold in the end portion of the sack, crimping means for crimping the end portions of the sack together at the zig-zag folded position, and clipping means for providing an annular clip below the crimped portion of the sack.

5. Apparatus according to claim 4, wherein the telescopic plates are interconnected with the filling nipple by a piston-cylinder pressure medium unit.

6. Apparatus according to claim 4, wherein the crimping means comprises a pair of members which are movable towards each other, said members comprising pull rods having an arcuate end embracing the folds of the sack.

* * * * *